US005517900A

United States Patent [19]

Kimura et al.

[11] Patent Number: 5,517,900

[45] Date of Patent: May 21, 1996

[54] TILTABLE SWASH PLATE TYPE COMPRESSOR

[75] Inventors: Kazuya Kimura; Masafumi Ito; Shigeki Kanzaki, all of Kariya, Japan

[73] Assignee: Kabushiki Kaisha Toyoda Jidoshokki Seisakusho, Aichi, Japan

[21] Appl. No.: 430,515

[22] Filed: Apr. 27, 1995

[30] Foreign Application Priority Data

Apr. 28, 1994 [JP] Japan ..... 6-091491

[51] Int. Cl.[6] ..... F01B 3/00

[52] U.S. Cl. ..... 92/12.2; 92/71

[58] Field of Search ..... 92/12.2, 71; 417/269, 417/222.1; 74/60; 91/505

[56] References Cited

U.S. PATENT DOCUMENTS 5,293,810 3/1994 Kimura et al. ..... 92/12.2
5,316,446 5/1994 Kimura et al. ..... 92/12.2
5,364,232 11/1994 Kimura et al. ..... 417/222.1

FOREIGN PATENT DOCUMENTS 5296407 8/1987 Japan .
1114988 8/1989 Japan .

*Primary Examiner*—Thomas E. Denion
*Attorney, Agent, or Firm*—Burgess, Ryan and Wayne

[57] ABSTRACT

A variable-capacity swash plate type compressor including a tiltable swash plate and a rotor supported by a drive shaft and connected to the swash plate by a hinge mechanism for controlling the tilting angle of the swash plate to change the capacity of the compressor. The hinge mechanism includes a pair of support arms extending from the rotor on either side of the top dead center position of the swash plate having holes, and a pair of guide pins extending from the swash plate and having balls fitted in the holes of the support arms. The holes are circular holes having different diameters. Alternatively, the holes are a circular hole and an oblong hole having a long width in the rotating direction.

8 Claims, 6 Drawing Sheets

TILTABLE SWASH PLATE TYPE COMPRESSOR

BACKGROUND OF THE INVENTION

1. Field of the Invention

The present invention relates to a variable-capacity swash plate type compressor used in, for example, an automotive air conditioning system.

2. Description of the Related Art

Known variable-capacity swash plate type compressors are disclosed in, for example, Japanese Unexamined Patent Publication No. 52-96407 and Japanese Unexamined Utility Model Publication No. 1-114988. The known-variable-capacity swash plate type compressors include a hinge mechanism for controlling the tilting angle of the swash plate to change the capacity of the compressor. The hinge mechanism K disclosed in the above described JUMP'988 is typically shown in FIGS. 6 and 7 of the attached drawings. The compressor includes a drive shaft 90, a swash plate 93, and a rotor 91. The swash plate 93 has a top dead center position T, located above the sheet of FIG. 6, at which the piston completes its compression stroke.

In this hinge mechanism K, the rotor 91 is attached to the drive shaft 90 on one side thereof and has an elongated hole 91*a* having a central axis S extending parallel to a plane passing through the axis O of the drive shaft 90 and the top dead center position T of the swash plate 93 and in a direction from an outer position to an inner position relative to the axis O of the drive shaft 90, as shown in FIG. 7. The elongated hole 91*a* includes extended walls which are straight in the direction perpendicular to the central axis S. A connecting pin 92 is slidably inserted in the elongated hole 91*a*, and the swash plate 93 is tiltably hinged to the connecting pin 92 via a bracket 93*a*. A wobble plate (not shown) can be slidably attached to the swash plate 93. Pistons are inserted in the cylinder bores, and piston rods are arranged between the wobble plate and the pistons.

In this compressor, the rotational movement of the drive shaft 90 is transmitted to the swash plate 93, for rotating the latter, by the hinge mechanism K and the rotational movement of the swash plate 93 is converted into a wobble movement of the wobble plate, whereby the rotational movement of the swash plate 93 is converted into a reciprocal movement of the pistons. Simultaneously, the hinge mechanism K functions to control the tilting angle of the swash plate 93 depending on the pressure in the crank chamber which is controlled by a control valve (not shown), to thereby change the stroke of the pistons to vary the capacity of the compressor.

During operation of the compressor, the tilting movement of the swash plate 93 and the wobble plate is regulated by the predetermined curvature of the elongated hole 91*a*, so that the top dead center position of the swash plate 93 does not change back and forth irrespective of the change in the tilting angle of the swash plate 93, and accordingly, the top clearance of the pistons at the top dead center thereof is maintained substantially at zero.

In this type of compressor, however, a suction force acts on a portion of the swash plate 93 (a right half portion in FIG. 6) that is located on the rear side from the top dead center position T in the rotational direction of the drive shaft 90 since a suction force acts on the pistons in the suction stroke, and a compression reactive force acts on a portion of the swash plate 93 (a left half portion in FIG. 6) that is located on the front side from the top dead center position T in the rotational direction of the drive shaft 90 since a compression force acts on the pistons in the compression stroke. Therefore, in this type of compressor, a portion of the swash plate 93 on the rear side from the top dead center position T in the rotational direction of the drive shaft 90 (hereinafter referred to a suction side) tends to move away from the rotor 90, while a portion of the swash plate 93 on the front side from the top dead center position T in the rotational direction of the drive shaft 90 (hereinafter referred to a compression side) tends to move toward the rotor 90.

In the compressor described in this prior art, the swash plate 93 is attached to the drive shaft 90 via a cylindrical sleeve (not shown) having pivot pins extending perpendicular to the axis O of the drive shaft 90 so that the swash plate cannot only slide relative to the drive shaft 90 but tilt back and forth. Therefore, it can be said that the swash plate 93 is prevented from being inclined relative to the rotor 91 right and left under the above described suction force and the compression reactive force.

However, the cylindrical sleeve and the pivot pins should have a little clearance to allow the swash plate 93 to move and tilt back and force relative to the drive shaft. Therefore, the swash plate 93 tends to be slightly inclined relative to the rotor 91 under the above described suction force and the compression reactive force (as depicted by the angle $\alpha$ in FIG. 6), so that the connecting pin 92 makes a point contact with the walls of the elongated hole 91*a*, as shown by the character "I" in FIGS. 6 and 7. The suction force and the compression reactive force are supported by the points "I".

The torque is transmitted from the drive shaft 90 to the swash plate 93 through the rotor 91 and the hinge mechanism K, and the torque is also supported by the points "I" if the swash plate 93 is more and less inclined relative to the rotor 91.

Therefore, in the conventional compressor, there is a possibility that an abnormal wear occurs in the hinge mechanism K which controls the tilting of the swash plate, during high-speed or high-load operation of the compressor, resulting in a shortened operational life. This problem also occurs in the compressor disclosed in Japanese Unexamined Patent Publication No. 52-96407. In addition, a similar problem also occurs when a spherical sleeve is used for tiltably and rotationally supporting the-swash plate for facilitating the manufacture of the compressor, and when hinge mechanisms are arranged on either side of the top dead center portion of the swash plate.

The assignee of the present invention then proposed Japanese Patent Application No. 5-81944 describing a compressor including a new hinge mechanism K having a pair of hinge elements. This hinge mechanism K is shown in FIG. 8 in the attached drawings. The hinge mechanism K includes a pair of support arms 81 and 82 extending rearwardly from a rotor 80 toward a swash plate 83 on either side from the top dead center position T (located above the sheet of FIG. 8) of the swash plate 83, and a pair of guide pins 86 and 87 having respective one ends attached to brackets 84 and 85 of the swash plate 83 on either side of the top dead center position T from the swash plate 83. Each support arm 81 or 82 has a circular hole 81*a* or 82*a* extending parallel to a plane passing through the axis O of the drive shaft 88 and the top dead center position T and in a direction from an outer position to an inner position relative to the axis O of the drive shaft 88. Each guide pin 86 or 87 has at its other end a ball 86*a* or 87*a* secured thereto, the balls 86*a* and 87*a* being identical in diameter to each other and fitted in the respective holes 81*a* and 82*a* of the support arms 81 and 82.

A spherical sleeve 89 is attached to the drive shaft 88 to support the swash plate 83 thereon, the spherical sleeve 89 being slidable relative to the drive shaft 88 along the axis O thereof.

A problem arises even in this compressor, that a noise or a vibration occurs due to a change in the pressure in the cylinder bores (not shown).

In this compressor, there is a widthwise inevitable error $|l_1-l_0|$ between the distance $l_1$ between the centers of the circular holes 81*a* and 82*a* and the distance 10 between the centers of the balls 86*a* and 87*a*, the widthwise error being likely to occur in the manufacturing process. In the assembly work of the compressor, it is necessary to accommodate this widthwise error $|l_1-l_0|$, by following means $$|l_1-l_0|\leqq(d_1-d_0)$$

where $d_1$ is the diameter of the circular holes 81*a* and 82*a*, and $d_0$ is the diameter of the balls 86*a* and 87*a*. That is, in this compressor, the diameter $d_1$ of the circular holes 81*a* and 82*a* must be comparatively greater than the diameter $d_0$ of the balls 86*a* and 87*a*, to absorb the widthwise error $|l_1-l_0|$. Therefore, there is a considerable gap between the circular hole 81*a* or 82*a* and the ball 86*a* or 87*a*, and the relationship of the ball 86*a* or 87*a* to the circular hole 81*a* or 82*a* is a freely movable, loose, fit rather than a slidable fit.

In the thus assembled compressor, the resultant force of the suction force and the compression reactive force derived from the not shown pistons to the swash plate 83 changes in its magnitude and in its acting point depending on the change in the pressures in the cylinder bores. For example, when the compression ratio is higher, the acting point of the resultant compressive force exists at a position between the circular holes 81*a* and 82*a*, and in this situation, the resultant compressive force pushes forward both balls 86*a* and 87*a* which are thus received by the front surfaces of the circular holes 81*a* and 82*a*.

When the compression ratio is lower or the pressure in the crank chamber increases, the acting point of the resultant force is displaced to the compression side (approximately the left hand half of FIG. 8) and does not exist at a position between the circular holes 81*a* and 82*a*. Therefore, in this situation, the ball 87*a* and the circular hole 82*a* on the compression side works as if it is a fulcrum so that a rearward force acts on the ball 86*a* on the suction side. This rearward force is received by the rear surface of the circular hole 81*a*.

It is desirable that the circular holes 81*a* and 82*a* receive the force constantly by their front surfaces only or by their rear surfaces only, but the circular holes 81*a* and 82*a* receive the force alternatingly by their front and rear surfaces since the pressure in the cylinder bores always changes depending on the suction, compression and discharge operation of the compressor and the point of the resultant force changes depending on the cyclic change in the pressure in the cylinder bores. Therefore, if a clearance between the circular hole 81*a* and the ball 86*a* is such a value as to establish a freely movable, loose fit rather than a slidable fit, the clearance is excessive and noise or vibration occurs because the forward and rearward forces are alternatingly received by the front and rear surfaces of the circular hole 81*a*.

In addition, in the compressor including guide pins 86 and 87 with balls 86*a* and 87*a* attached thereto, and if the widthwise error $|l_1-l_0|$is accommodated by the minimum in the allowable range, that is, if the following relationship exists, $$|l_1-l_0|=(d_1-d_0)$$

the circular holes 81*a* and 82*a* are always in abutment with the points of the balls 86*a* and 87*a* on the front side and on the rear side thereof in the rotational direction, so the torque is transmitted from both circular holes 81*a* and 82*a*, both balls 86*a* and 87*a* and both guide pins 86 and 87 to the swash plate 83. In this case, if the swash plate 83 is inclined to the right or to the left due to the suction force and the compression reactive force as described above or the swash plate 83 is pushed by the compression reactive force, at least one of the guide pins 86 and 87 is subjected to a stress, and an endurance of the parts will deteriorate.

SUMMARY OF THE INVENTION

The object of the present invention is to provide a variable-capacity swash plate type compressor having a swash plate, a rotor and a hinge mechanism between the swash plate and the rotor for controlling the tilting of the swash plate, in which an abnormal wear of the elements is minimized even if the swash plate is inclined to the right or to the left.

Another object of the present invention is to provide a variable-capacity swash plate type compressor in which the management of manufacturing the compressor can be facilitated.

A further object of the present invention is to provide a variable-capacity swash plate type compressor in which noise and vibration, depending on a change in the pressure in cylinder bores thereof, are minimized and a superior endurance of the parts is ensured.

According to the present invention, there is provided a variable-capacity swash plate type compressor comprising a housing having a crank chamber, a suction chamber, a discharge chamber, and cylinder bores, the cylinder bores being interconnected to the crank chamber, the suction chamber and the discharge chamber. Pistons are arranged in the respective cylinder bores, and a drive shaft rotatably arranged in the housing and having an axis, the drive shaft being adapted to rotate in a predetermined direction. A swash plate is arranged in the crank chamber and rotatably and tiltably mounted to the drive shaft, the swash plate having a top dead center position. Means is arranged between the swash plate and the pistons for converting the rotational movement of the swash plate into the reciprocal movement of the pistons. A rotor is arranged in the crank chamber and supported by the drive shaft for synchronous rotation therewith. A hinge mechanism is arranged between the rotor and the swash plate for controlling the tilting angle of the swash plate to change a capacity of said compressor depending on the pressure in the crank chamber. The compressor is characterized in that the hinge mechanism comprises a pair of support arms extending from the rotor toward the swash plate on either side of the top dead center position, each of the support arms having a hole extending parallel to a plane passing through the axis of the drive shaft and the top dead center position and in a direction from an outer position to an inner position relative to the axis of the drive shaft. The hinge mechanism also comprises a pair of guide pins having respective one ends fixed to the swash plate on either side of the top dead center position and other ends having balls secured thereby, each of the balls being fitted in each of the holes of the support arms. A gap between one hole and the associated ball, measured at least in the rotational direction of the drive shaft, is substantially zero and smaller than a gap between the other hole and the associated ball, measured in the same direction. The holes have different sizes from each other, or the balls have the different sizes from each other, for changing the gaps.

In this arrangement, the balls of the guide pins are fitted in the holes and maintain a line contact with the wall of the holes to support the suction force, the compression reactive force, and the torque even if the swash plate is inclined to the right or to the left. In this compressor, the holes are arranged perpendicular to the rotational direction of the rotor, so that the torque which the rotor receives from the shaft is easily transmitted to the balls.

In this compressor, an inevitable widthwise error occurs, but this widthwise error is accommodated by the fact that the gap between one hole and the associated ball is substantially zero and the gap between the other hole and the associated ball is relatively great.

In the compressor assembled in this way, regarding the resultant force of the suction force and the compression reactive force acting on the swash plate from the pistons, the magnitude and the acting point of the resultant force always change depending on the change in the pressure in the cylinder bores. In this situation, a forward force and a rearward force act on the ball on the suction side upon the cyclic change in the pressure in the cylinder bores during the suction, compression and discharge operation, the forward and rearward forces are received by the front and rear surfaces of the hole, which is preferably one which provides a substantially zero gap.

Since the ball on the suction side is slidably fitted in the circular hole, the clearance therebetween is not so great as to cause a noise or a vibration irrespective of the cyclic change in the pressure in the cylinder bores.

In particular, if the ball on the suction side is slidably fitted in the hole and the ball on the compression side is freely movably fitted in the circular hole, the torque is mainly transmitted from the hole on the suction side to the associated ball, and the torque is not substantially transmitted from the hole on the compression side to the associated ball. Therefore, the ball on the suction side will not cause a noise or a vibration at all, and the guide pins will not be subjected to a stress even if the swash plate tends to be inclined to the right and to the left due to the suction force and the compression reactive force.

In one preferred embodiment, the holes have circular cross-sections with different diameters from each other.

Preferably, the balls have an identical diameter to each other, one of the circular holes that is located on the rear side from the top dead center position in the rotational direction of the drive shaft has a diameter substantially identical to the diameter of the ball, and the other circular hole that is located on the front side from the top dead center in the rotational direction of the drive shaft has a diameter greater than the diameter of said one circular hole.

In another preferred embodiment, one of the holes has a circular cross-section, and the other hole has an oblong cross-section having a short width along a short axis extending parallel to the axis of the drive shaft and a long width along a long axis extending in the rotating direction of the drive shaft.

In this case, the balls have an identical diameter to each other, the circular hole is located on the rear side from the top dead center position in the rotational direction of the drive shaft and has a diameter substantially identical to the diameter of the ball, and the oblong hole is located on the front side from the top dead center in the rotational direction of the drive shaft, the long width of the oblong hole being greater than the diameter of the ball and the short width thereof substantially identical to the diameter of the ball.

Alternatively, the balls have an identical diameter to each other, the circular hole is located on the front side from the top dead center position in the rotational direction of the drive shaft and has a diameter substantially identical to the diameter of the ball, and the oblong hole is located on the rear side from the top dead center in view of the rotational direction of the drive shaft, the long width of the oblong hole being greater than the diameter of the ball and the short width thereof substantially identical to the diameter of the ball.

BRIEF DESCRIPTION OF THE DRAWINGS

The present invention will become more apparent from the following description of the preferred embodiments, with reference to the accompanying drawings, in which.

DESCRIPTION OF THE PREFERRED EMBODIMENTS

Figure 1:
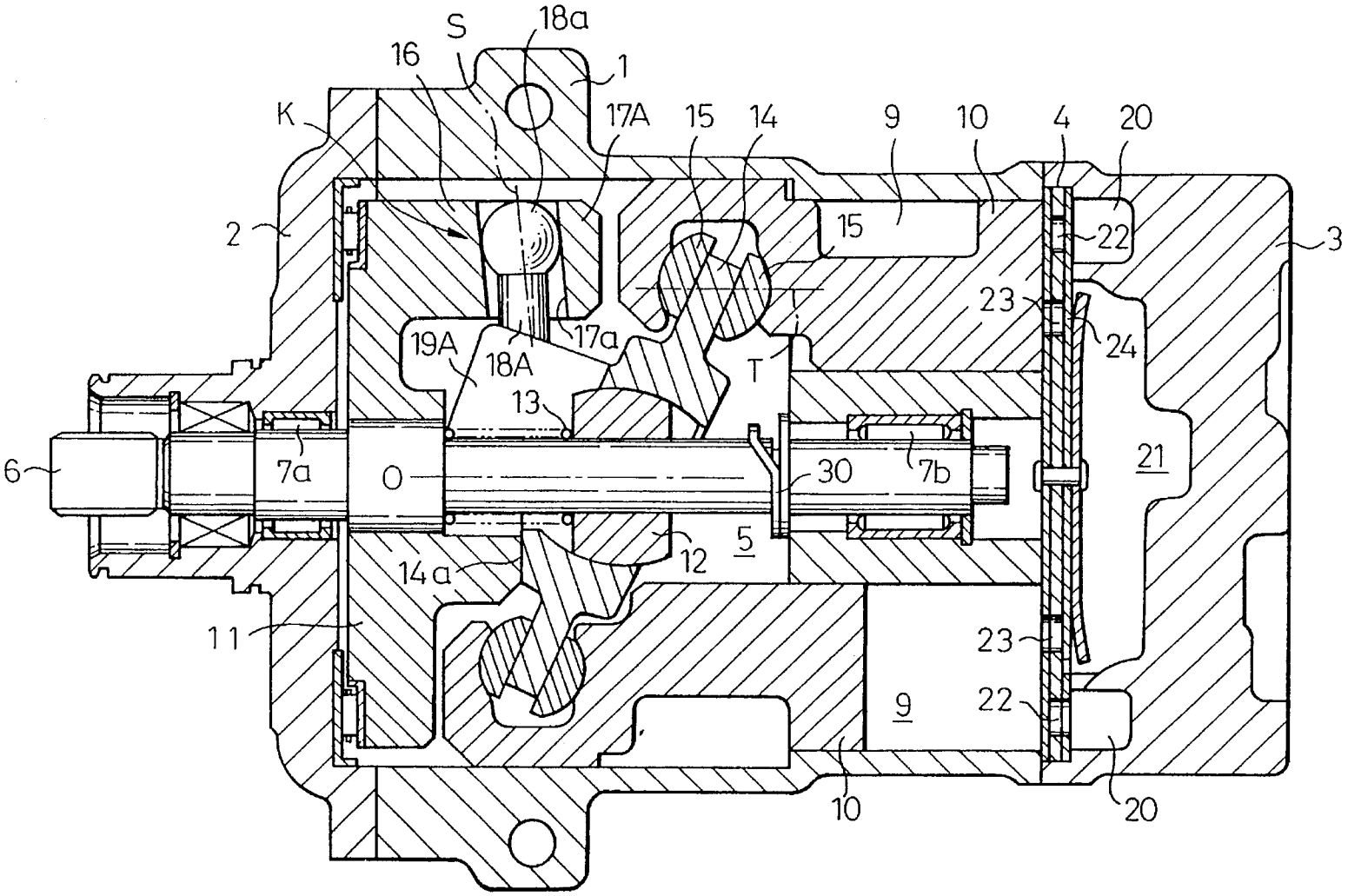
FIG. 1 is a longitudinal cross-sectional view of a compressor according to the first embodiment of the present invention.
Figure 2:
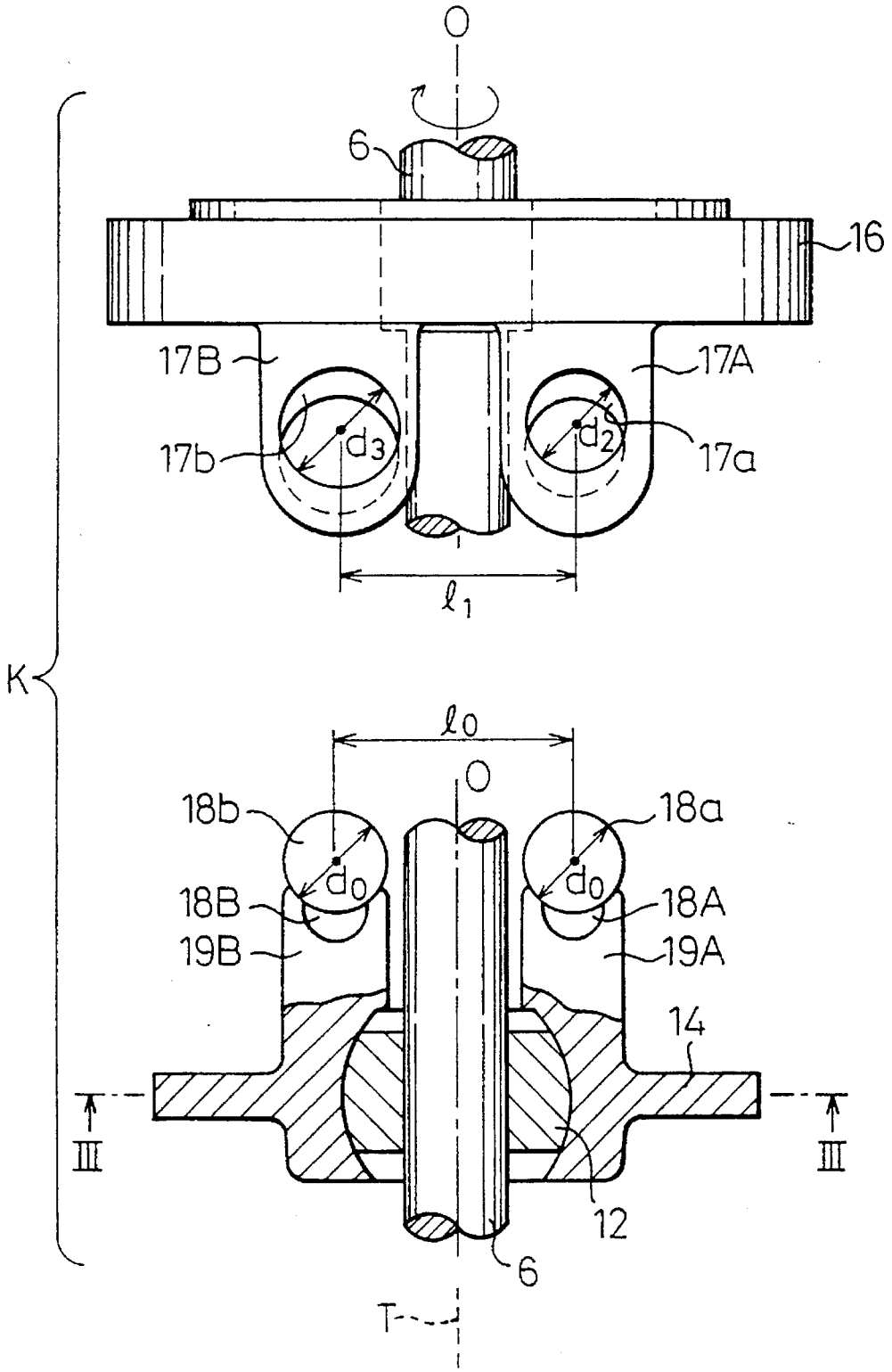
FIG. 2 is an exploded, partly cross-sectional, plan view of the hinge mechanism-of the compressor of FIG. 1.
Figure 3:
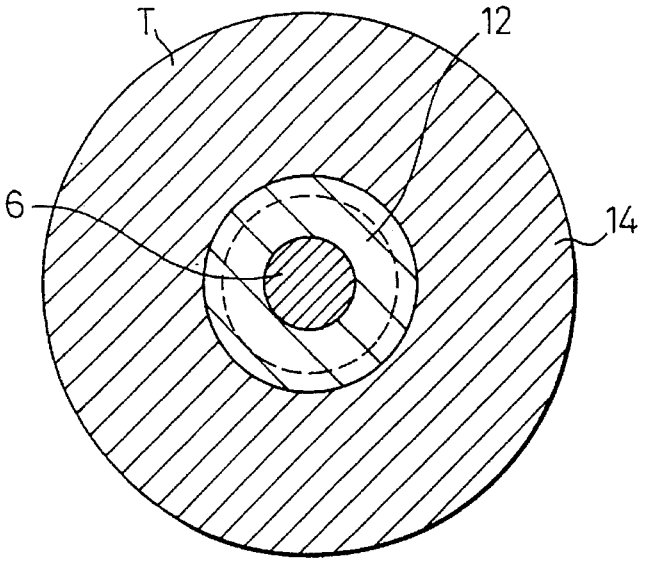
FIG. 3 is a cross-sectional view of the swash plate of FIG. 2, taken along the lines III—III in FIG. 2.

Referring to FIGS. 1 to 3, the compressor according to the first embodiment of the present invention includes a housing consisting of a cylinder block 1, a front housing 2 coupled to the front end of the cylinder block 1, and a rear housing 3 coupled to the rear end of the cylinder block 1, with a valve plate 4 interposed between the cylinder block 1 and the rear housing 3. A crank chamber 5 is formed in the cylinder block 1 and the front housing 2, and a drive shaft 6 is arranged in the crank chamber 5. The drive shaft 6 is rotatably supported by bearings 7*a* and 7*b*. A plurality of cylinder bores 9 are arranged in the cylinder block 1 around the drive shaft 6, and pistons 10 are inserted in the respective cylinder bores 9.

A rotor 16 is supported by the drive shaft 6 in the crank chamber 5 for synchronous rotation with the drive shaft 6, and a spherical sleeve 12 is slidably supported by the drive shaft 6 in the crank chamber 5. A compression spring 13 is arranged between the rotor 16 and the spherical sleeve 12 for biassing the spherical sleeve 12 toward the rear housing 3. A swash plate 14 is rotatably and tiltably supported by the spherical sleeve 12. The swash plate 14 has on the rear side thereof an inclined abutment surface 14*a* which can abut against the rotor 16 to restrict the tilting of the swash plate 14 in the course of increasing the tilting angle when the compression spring 13 is in the most compressed position, as shown in FIG. 1. Also, the tilting of the swash plate 14 is restricted in the course of decreasing the tilting angle, by a stopper 30 anchored to the drive shaft 6 which can abut against the spherical sleeve 12 when the compression spring 13 is in the most extended position.

Semi-circular shoes 15 are arranged between the swash plate 14 and the pistons 10 for converting the rotational movement of the swash plate 14 into the reciprocal movement of the pistons 10. The flat surfaces of the shoes 15 are in contact with the surfaces of the swash plate 14 at the peripheral region thereof, and the spherical surfaces of the shoes 15 are engaged in semicircular grooves in the pistons 10. The pistons 10 are thus connected to the swash plate 14 via the shoes 15 and can reciprocally move in the cylinder bores 9, respectively. The swash plate 14 has a top dead center position T at which each of the pistons 10 completes the compression stroke.

The compressor includes a hinge mechanism K for controlling the tilting of the swash plate 14 to change the capacity of the compressor. The hinge mechanism K includes a pair of brackets 19A and 19B extending from the front surface of the swash plate 14 on either side of the top dead center position T of the swash plate 14, so that the drive shaft 6 is located between the brackets 19A and 19B when viewed from the top dead center position T, as shown in FIG. 2. Guide pins 18A and 18B are fixed at their one ends-to the brackets 19A and 19B, and have at the other ends thereof balls 18*a* and 18*b*.

The hinge mechanism K also includes a pair of support arms 17A and 17B extending rearwardly from the upper portion of the rear surface of the rotor 16 parallel to the axis O of the drive shaft in an opposite relationship with the guide pins 18A and 18B. Circular holes 17*a* and 17*b* are arranged through the support arms 17A and 17B to extend parallel to a plane passing through the axis O of the drive shaft 6 and the top dead center position T of the swash plate 14 and in a direction from an outer position to an inner position relative to the axis O of the drive shaft 6. As shown in FIG. 1, each of the circular holes 17*a* and 17*b* has a straight center line S and extends such that the top dead center position of the pistons 10 will be constant even when the tilting angle of the swash plate 14 changes. These circular holes 17*a* and 17*b* are cut or machined by a drill, and the cross-section thereof taken perpendicular to the center line S is a circular shape. The balls 18*a* and 18*b* of the guide pins 18A and 18B are rotatably and slidably fitted in the circular holes 17*a* and 17*b*, respectively.

The feature of this compressor resides in the relationship of the circular holes 17*a* and 17*b* to the balls 18*a* and 18*b*. That is, in this compressor, there is an inevitable widthwise error $|l_1-l_0|$ between the distance 11 between the centers of the circular holes 17*a* and 17*b* and the distance 10 between the centers of the balls 18*a* and 18*b*, occurring in the manufacturing process. In this compressor, the balls 18*a* and 18*b* have the identical diameter $d_0$ to each other, the circular hole 17*a* located on the rear side (suction side) from the top dead center position T in the rotational direction of the drive shaft 6 (as shown by the arrow in FIG. 2) has the diameter $d_2$ which is only slightly greater than the diameter $d_O$ of the ball 18*a*, and the circular hole 17*b* located on the front side (compression side) from the top dead center position T in the rotational direction of the drive shaft 6 has the diameter $d_3$ which is significantly greater than the diameter $d_2$ of the ball 18*b*.

Therefore, the widthwise error $|l_1-l_0|$ is accommodated by the fact that the circular hole 17*b* on the compression side is greater than the circular hole 17*a* on the suction side. Therefore, it can be said that the circular hole 17*a* on the suction side has a diameter substantially identical to the diameter of the ball 18*a*, because it is not necessary that a clearance between the circular hole 17*a* and the ball 18*a* is greater than a value necessary allow the ball 18*b* to slide in the circular hole 17*a*. The ball 18*a* on the suction side is thus slidably fitted in the circular hole 17*a*, and the ball 18*b* is freely movably and loose fitted in the circular hole 17*b*. Since the balls 18*a* and 18*b* have the identical diameter $d_0$ to each other, it is not necessary to distinguish the ball 18*a* on the suction side from the ball 18*b* on the compression side, and therefore, the management of the manufacturing is facilitated.

The rear housing 3 is separated into a suction chamber 20 and a discharge chamber 21, as shown in FIG. 1. The valve plate 4 has a suction port 22 and a discharge port 23 for each cylinder bore 9. A compression chamber is formed between the valve plate 4 and the piston 10 in each of the cylinder bores 9 and is in communication with the suction chamber 20 and the discharge chamber 21 via the suction port 22 and the discharge port 23, respectively. Also, a suction valve (not shown) is arranged in each suction port 22 for opening and closing each suction port 22 in response to the reciprocal movement of the piston, and a discharge valve (not shown) is arranged in each discharge port 23 for opening and closing each suction port 22 in response to the reciprocal movement of the piston 10 with a retainer 24 restricting the opening of the discharge valve. In addition, a control valve (not shown) is arranged in the rear housing 3 for admitting the cooling gas into the crank chamber 5 to control the pressure in the crank chamber 5.

In the operation of the above described compressor, when the drive shaft 6 is rotated, the swash plate 14 is rotated therewith and the rotational movement of the swash plate 14 is transmitted to the pistons 10 via the shoes 15 and the pistons 10 move reciprocally. The cooling gas is thus introduced from the suction chamber 20 into the compression chamber in each cylinder bore 9, compressed in the compression chamber, and then discharged into the discharge chamber 21. The amount of the gas discharged into the discharge chamber 21 is controlled by controlling the tilt of the swash plate 14 which depends on the pressure in the crank chamber 5 and is controlled by the control valve.

In particular, when the pressure in the crank chamber 5 decreases due to the operation of the control valve, the back pressure acting on the pistons 10 decreases, and the tilting angle of the swash plate 14 becomes greater. That is, the balls 16*a* and 18*b* of the guide pins 18A and 18B in the hinge mechanism K move rearwardly (clockwise in FIG. 1) in the circular holes 17*a* and 17*b* and slide outwardly along the center line S in the circular holes 17*a* and 17*b* away from the axis O of the drive shaft 6. The swash plate 14 thus tilts rearwardly around the spherical sleeve 12 and the spherical sleeve 12 moves forward against the compression spring 13. In this manner, the tilting angle of the swash plate 14 becomes greater and the stroke of the pistons 10 is extended, resulting in an increase in the discharge capacity of the compressor.

However, when the pressure in the crank chamber 5 increases by the operation of the control valve, the back pressure acting on the pistons 10 increases, and the tilting angle of the swash plate 14 becomes smaller. That is, the balls 16*a* and 18*b* of the guide pins 18A and 18B in the hinge mechanism K move forwardly (anticlockwise in FIG. 1) in the circular holes 17*a* and 17*b* and slide inwardly along the center line S in the circular holes 17*a* and 17*b* toward the axis O of the drive shaft 6. The swash plate 14 thus tilts forwardly around the spherical sleeve 12 and the spherical sleeve 12 is moved rearward, toward the stopper 30, by the compression spring 13. In this manner, the tilting angle of the swash plate 14 becomes smaller and the stroke of the pistons 10 is shortened, resulting in a decrease in the discharge capacity of the compressor.

During the operation of the compressor, the pistons 10 in the suction stroke receive a suction force, and the suction force acts on a portion of the swash plate 14 on the suction side (right hand half in FIG. 2). On the other hand, the pistons 10 in the compression stroke receive a compression reactive force, and the compression reactive force acts on a portion of the swash plate 14 on the compression side (left hand half in FIG. 2). Therefore, a portion of the swash plate 14 on the suction side tends to move away from the rotor 16, and a portion of the swash plate 14 on the compression side tends to be pushed toward the rotor 16.

In this compressor, the support arms 17A and 17B, and the guide pins 18A and 18B are arranged on either side of the top dead center position T of the swash plate 14. Accordingly, the suction force and the compression reactive force from the pistons 10 are appropriately supported by the respective support arms 17A and 17B and the guide pins 18A and 18B, so that the swash plate 14 is substantially prevented from being inclined to the left and to the right relative to the rotor 16.

However, in this compressor, the spherical sleeve 12 is used for tiltably and rotatably supporting the swash plate 14 to facilitate the manufacturing the compressor, and a clearance exists between the circular holes 17*a* and 17*b* and the balls 18*a* and 18*b*, for tiltably moving the swash plate 14. Therefore, the swash plate 14 may be slightly inclined to the left and to the right relative to the rotor 16, that is, the right half portion may move downward and the left half portion may move upward in FIG. 2.

In this case, the circular holes 17*a* and 17*b* and the balls 18*a* and 18*b* maintain a line contact therebetween, and support the compression reactive force and the torque along the line of contact. Therefore, in this compressor, an occurrence of an abnormal wear in-the hinge mechanism K for controlling the tilting motion of the swash plate 14 during the high speed operation or the high compression ratio operation of the compressor is reliably avoided, and a superior endurance is ensured.

In addition, in this compressor too, the magnitude and the acting point of the resultant force of the suction force and the compression reactive force acting on the swash plate 14 from the pistons 10 always change depending on the change in the pressure in the cylinder bores 9.

For example, when the compression ratio is higher, the acting point of the resultant force exists at a position between the circular holes 17*a* and 17*b*. Therefore, in this situation, the resultant force acts forwardly on both balls 18*a* and 18*b*, and is received by the front surfaces of the circular holes 17*a* and 17*b*.

When the compression ratio is lower or the pressure in the crank chamber 5 increases, the acting point of the resultant force moves to the compression side and does not exist at a position between the circular holes 17*a* and 17*b*. Therefore, in this situation, a forward force and a rearward force alternatingly act on the ball 18*a* on the suction side upon the cyclic change in the pressure in the cylinder bores 9 during the suction, compression and discharge operation, and the forward and rearward forces are received by the front and rear surfaces of the circular hole 17*a*.

Since the ball 18*a* on the suction side is slidably fitted in the circular hole 17*a*, the clearance therebetween is not so great as to cause a noise or a vibration even though the pressure in the cylinder bores 9 cyclically changes.

In this compressor, the circular holes 17*a* and 17*b* are arranged to intersect the rotational direction of the rotor 16, and the torque from the drive shaft 6 to the rotor 16 can be securely transmitted from the rotor 16 to the balls 18*a* and 18*b*. In particular, since the-ball 18*a* on the suction side is slidably fitted in the circular hole 17*a* and the ball 18*b* on the compression side is freely movably fitted in the circular hole 17*b*, the torque is mainly transmitted from the circular hole 17*a* on the suction side to the ball 18*a*, and the torque is not substantially transmitted from the circular hole 17*b* on the compression side to the ball 18*b*. Therefore, the ball 18*a* on the suction side will not cause a noise or a vibration at all, and the guide pins 18A and 18B will not be subjected to stress even if the swash plate 14 tends to be inclined to the right or to the left due to the suction force and the compression reactive force. Therefore, it is possible to provide a compressor of a superior endurance. The circular hole 17*a* and the ball 18*a* on the suction side reliably maintain a line contact therebetween, and the circular hole 17*b* and the ball 18*b* on the compression side maintain a line contact therebetween although this line contact is close to a point contact.

In this compressor, the circular holes 17*a* and 17*b* are cut or machined by a drill. It is therefore possible to reduce the manufacturing cost.

In this compressor, the balls 18*a* and 18*b* have the identical diameter $d_0$ to each other, and it is not necessary to distinguish the ball 18*a* on the suction side from the ball 18*b* on the compression side. Therefore, manufacturing management is easy.

It is possible to substitute the relationship of the circular holes 17*a* and 17*b* and the balls 18*a* and 18*b*. That-is, the circular holes 17*a* and 17*b* can have the identical diameter to each other, and the ball 18*a* on the suction side can have a diameter adapted to be slidably fitted on the circular hole 17*a*, and the ball 18*b* on the compression can have a diameter smaller than the diameter of the ball 18*a* on the suction side so that the ball 18*b* is freely movably and loosely fitted in the circular hole 17*b*. In this case, the fabrication of the circular holes 17*a* and 17*b* becomes easier, but the manufacturing management of the balls 18*a* and 18*b* becomes somewhat more cumbersome, rather than those in the above described embodiment.

In addition, in this compressor, the direction of the center line S of each of the circular holes 17*a* and 17*b* is determined such that the top dead center position of the pistons 10 will be constant regardless of the change in the tilting angle of the swash plate 14 in any particular capacity operations. The tilting of the swash plate is thus controlled and the top clearance of the pistons 10 at the top dead center thereof is in the allowable range.

Figure 4:
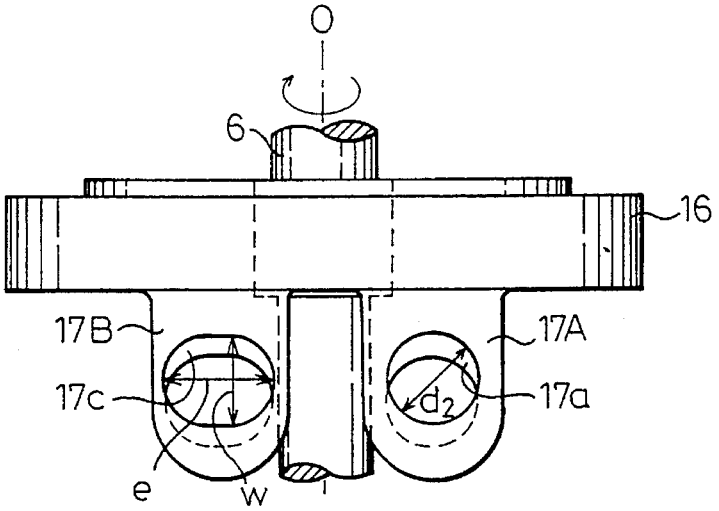
FIG. 4 is a plan view of a portion of the hinge mechanism of a compressor according to the second embodiment of the present invention.

FIG. 4 shows the second embodiment of the present invention. This embodiment includes elements similar to those of the compressor of the first embodiment illustrated in FIGS. 1 to 3, except that the circular hole 17*b* on the compression side in the first embodiment is replaced by an oblong hole 17*c*. Elements of FIG. 4 similar to those of the first embodiment are illustrated by the identical reference numerals, and a detailed explanation thereof is omitted here.

The hinge mechanism of this embodiment includes the balls 18*a* and 18*b* having identical diameters $d_O$ (see FIG. 2). The circular hole 17*a* on the suction side has the diameter $d_2$ slightly greater than the diameter $d_0$. The oblong hole 17*c* on the compression side has a cross section having a width "w"

along a short axis extending parallel to the axis O of the drive shaft 6 and a width "e" along a long axis extending perpendicular to the axis O of the drive shaft 6 and thus parallel to the rotating direction of the drive shaft 6. The width "w" is slightly greater than the diameter $d_0$, and the width "e" is significantly greater than the diameter $d_O$. The oblong hole 17*c* can be formed by machining using a drill and thereafter an end-mill.

In this compressor too, the suction force, the compression reactive force and the torque are supported by the line contact between the circular hole 17*a* and the ball 18*a* and the line contact between the oblong hole 17*c* and the ball 18*b*, and the torque from the drive shaft 6 to the rotor 16 is easily transmitted to the balls 18*a* and 18*b*.

The feature of this compressor is as follows. An inevitable widthwise error 10 exists between the centers of the balls 18*a* and 18*b*. However, this widthwise error is accommodated by the fact that the oblong hole 17*c* on the compression side has the long width "e" in the rotating direction of the drive shaft 6. Therefore, it can be said that the circular hole 17*a* on the suction side has a diameter substantially identical to the diameter of the ball 18*a*, because it is not necessary that a clearance between the circular hole 17*a* and the ball 18*a* is greater than a value necessary to allow the ball 18*b* to slide in the circular hole 17*a*. On the other hand, the oblong hole 17*c* on the compression side has the width "w" parallel to the axis O of the drive shaft 6 substantially identical to the diameter of the ball 18*b*, and it is not necessary that a clearance between the oblong hole 17*c* and the ball 18*b* in the direction of the axis O of the drive shaft 6 is greater than a value necessary to allow the ball 18*b* to slide in the oblong hole 17*c*. Therefore, in this compressor, the ball 18*a* on the suction side is slidably fitted in the oblong hole 17*a*, and the ball 18*b* on the compression side is slidably fitted in the oblong hole 17*c* in the direction of the axis O of the drive shaft 6 and is freely movably and loosely fitted in the oblong hole 17*c* in the rotational direction of the drive shaft 6.

Since the ball 18*a* on the suction side is slidably fitted in the circular hole 17*a*, the clearance therebetween is not so great as to cause noise or vibration irrespective of the cyclic change in the pressure in the cylinder bores 9.

In this compressor, the torque from the drive shaft 6 is transmitted only through the circular hole 17*a* on the suction side and the ball 18*a*, since the circular hole 17*a* on the suction side is slidably fitted over the ball 18*a* and the oblong hole 17*c* on the compression side is rotatably and loosely fitted over the ball 18*b*. Therefore, the ball 18*a* on the suction side will not cause any noise or vibration, and the guide pins 18A and 18B will not be subjected to a stress even if the swash plate 14 tends to be inclined to the right and to the left due to the suction force and the compression reactive force. The circular hole 17*a* and the ball 18*a* on the suction side reliably maintain a line contact therebetween, and the oblong hole 17*c* and the ball 18*b* on the compression side make a point contact.

Further in this compressor, the circular hole 17*a* can be machined by a drill and the manufacture is facilitated. Since the guide pins 18A and 18B will not be subjected to a stress, it is possible to provide a compressor having a higher endurance.

Figure 5:
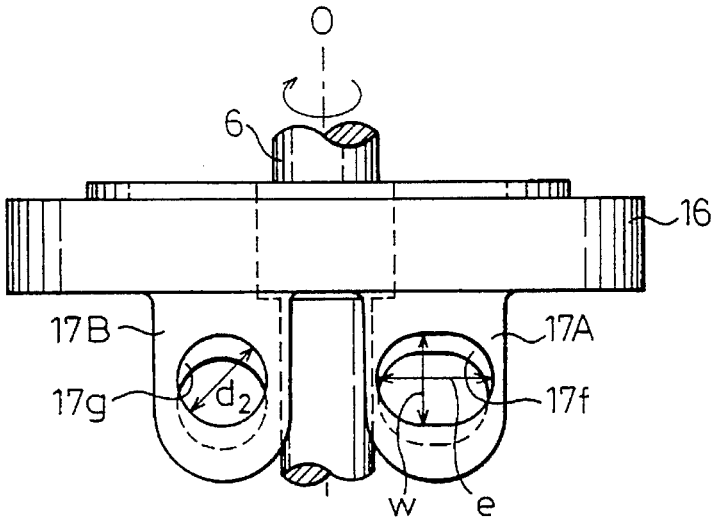
FIG. 5 is a plan view of a portion of the hinge mechanism of a compressor according to the third embodiment of the present invention.
Figure 6:
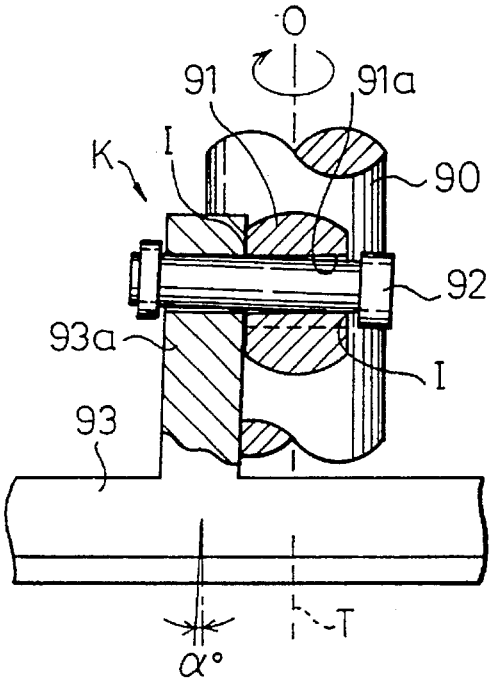
Fig.6 PRIOR ART
FIG. 6 is a partly cross-sectional, plan view of a hinge mechanism of a conventional compressor.
Figure 7:
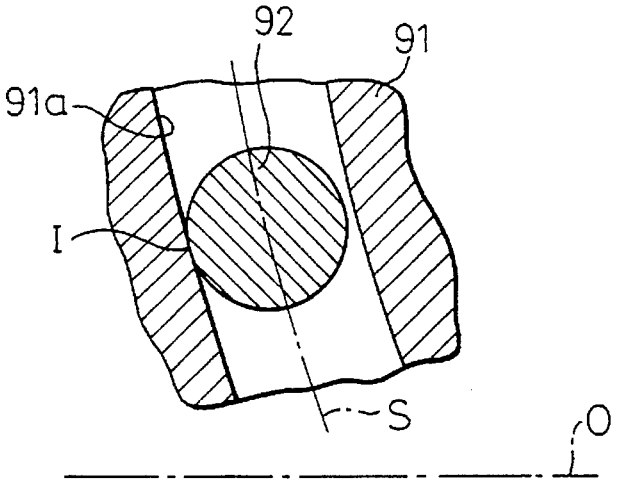
Fig.7 PRIOR ART
FIG. 7 is a cross-sectional view of the rotor of FIG. 6.
Figure 8:
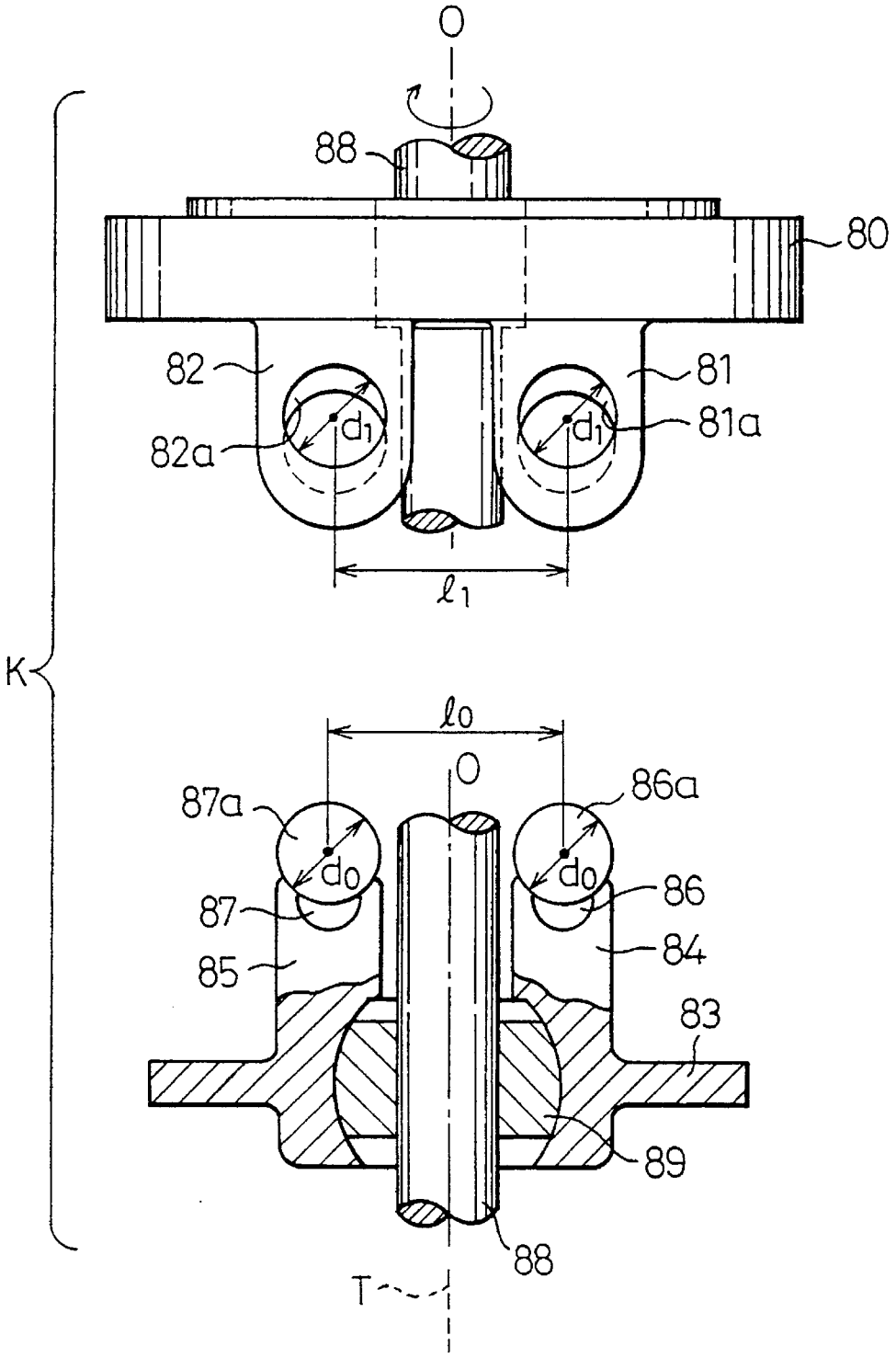
FIG. 8 is an exploded, partly cross-sectional, plan view of a hinge mechanism of a compressor on which the present invention based.

FIG. 5 shows the third embodiment of the present invention. This embodiment includes elements similar to those of compressor of the first embodiment illustrated in FIGS. 1 to 3, except that the circular hole 17*a* on the suction side in the first embodiment is replaced by an oblong hole 17*f*, and the circular hole on the compression side is represented by the reference numeral 17*g*. This embodiment includes balls 18*a* and 18*b* having identical diameters $d_0$ (see FIG. 2). The circular hole 17*g* on the compression side has the diameter $d_2$ slightly greater than the diameter $d_0$. The oblong hole 17*f* on the suction side has a cross section having a short width "w" along a short axis extending parallel to the axis O of the drive shaft 6 and the long width "e" along a long axis extending perpendicular to the axis O of the drive shaft 6 and thus parallel to the rotating direction of the drive shaft 6. The short width "w" is slightly greater than the diameter d*0*, and the long width "e" is significantly greater than the diameter $d_0$. The oblong hole 17*f* can be formed by machining using a drill and thereafter an end-mill.

In this compressor too, the suction force, the compression reactive force and the torque are supported by the line contact, and the torque from the drive shaft 6 to the rotor 16 is easily transmitted to the balls 18*a* and 18*b*.

In this compressor too, an inevitable widthwise error 10 exists between the centers of the balls 18*a* and 18*b*. However, this widthwise error is accommodated by the fact that the oblong hole 17*f* on the suction side has the long width "e" extending parallel to the rotating direction of the drive shaft 6. Therefore, it can be said that the oblong hole 17*f* on the suction side has a short width "w" substantially identical to the diameter of the ball 18*a*, and it is not necessary that a clearance between the oblong hole 17*f* and the ball 18*a* in the direction of the axis O of the drive shaft 6 is greater than a value necessary to allow the ball 18*a* to slide in the oblong hole 17*f*. On the other hand, the circular hole 17*g* on the compression side has the diameter $d_2$ substantially identical to the diameter of the ball 18*b*, and it is not necessary that a clearance between the circular hole 17*g* and the ball 18*b* is greater than a value-necessary to allow the ball 18*b* to slide in the circular hole 17*g*. Therefore, in this compressor, the ball 18*a* on the suction side is slidably fitted in the oblong hole 17*f* in the direction of the axis O of the drive shaft 6 and freely movably, loose fitted in the oblong hole 17*c* in the rotational direction of the drive shaft 6, and the ball 18*b* on the compression side is slidably fitted in the circular hole 17*g*.

Since the ball 18*a* on the suction side is slidably fitted in the circular hole 17*a*, the clearance therebetween is not so great as to cause noise or vibration irrespective of the cyclic change in the pressure in the cylinder bores 9.

In this compressor, the torque from the drive shaft 6 is transmitted only through the circular hole 17*g* on the compression side and the ball 18*b*, since the circular hole 17*g* on the compression side is slidably fitted over the ball 18*b* and the oblong hole 17*f* on the suction side is rotatably and loosely fitted over the ball 18*a*. Therefore, the ball 18*g* on the compression side will not cause a noise or a vibration at all, and the guide pins 18A and 18B will not be subjected to a stress even if the swash plate 14 tends to be inclined to the right and to the left due to the suction force and the compression reactive force. The circular hole 17*g* and the ball 18*b* on the compression side reliably maintain a line contact therebetween, and the oblong hole 17*f* and the ball 18*a* on the suction side make a point contact, so a wear is prevented.

Further, in this compressor, the circular hole 17*g* can be machined by a drill and the manufacture thereof is easy. Since the guide pins 18A and 18B will not subjected to a stress, it is possible to provide a compressor having a high endurance.

It is possible to replace the connecting means using the shoes 15 to any connecting means such as piston rods which connect the swash plate 14 to the pistons 10. It is also possible to use a wobble plate between the swash plate 14 and the pistons 10 for converting the rotational motion of the swash plate 14 into the reciprocal movement of the pistons 10, the wobble plate being slidable relative to the swash plate 14 but not rotating by itself, as is well known.

It is also possible to arrange the circular holes 17*a*, 17*b*, and 17*g* and the oblong holes 17*c* and 17*g* so that the center line thereof is curved and can maintain a constant top dead center position of the pistons 10 at a minimum variation, so that the top clearance of the pistons 10 at the top dead center thereof is substantially O.

It is also possible to arrange the circular holes 17*a*, 17*b*, and 17*g* and the oblong holes 17*c* and 17*g* so that one ends thereof are closed or partly closed to prevent the balls from escaping therefrom. It is also possible to arrange the balls 18*a* and 18*b* so that they are rotatably secured by the other ends of the guide pins 18A and 18B, whereby the balls 18*a* and 18*b* roll in the circular holes 17*a*, 17*b*, and 17*g* and the oblong holes 17*c* and 17*g*. In this case, the balls 18*a* and 18*b* move in the circular holes 17*a*, 17*b*, and 17*g* and the oblong holes 17*c* and 17*g* with a low coefficient of friction, and the discharging capacity is smoothly varied.

As explained in greater detail, according to the present invention, an occurrence of an abnormal wear in the hinge mechanism is prevented, even if the swash plate tends to be inclined to the right or to the left, because the circular holes or the oblong holes maintain a line contact with the balls. Especially in this compressor, since one of the circular holes or the oblong hole in the pair of mating elements is loosely fitted over the ball, the guide pins 18A and 18B will not be subjected to a stress, and it is possible to provide a compressor having a high endurance.

Since the circular hole or the oblong hole on the suction side in the pair of mating elements is slidably fitted over the ball in the direction of the axis of the drive shaft, the clearance between the circular hole or the oblong hole and the ball is not so great as to cause a noise or a vibration irrespective of the cyclic change in the pressure in the cylinder bores.

The sizes of the holes 17*a* and 17*b* are changed from each other and the balls 18*a* and 18*b* have the identical sizes in the previous embodiments, but it is possible that the sizes of the balls 18*a* are changed from each other and the holes 17*a* and 17*b* have the identical sizes, so that a gap between one hole and the associated ball is substantially zero and smaller than a gap between the other hole and the associated ball.

Figure 9:
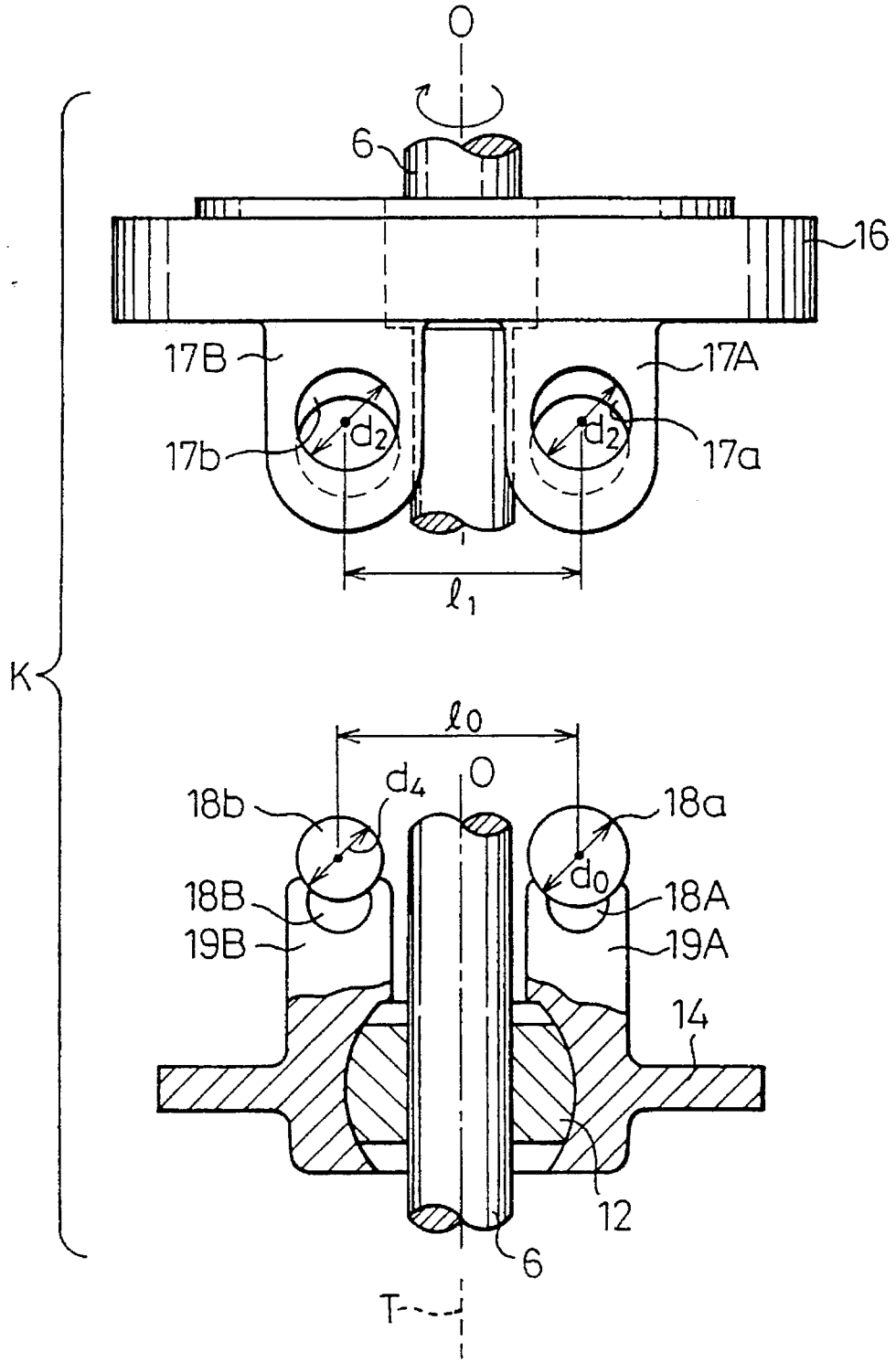
FIG. 9 is a view of the hinge mechanism according to the fourth embodiment of the present invention.

FIG. 9 shows the hinge mechanism of the fourth embodiment of the present invention. In this example, the holes 17*a* and 17*b* have the identical sizes $d_2$, the ball 18*a* has the diameter $d_0$, and the ball 18*b* has the diameter $d_4$ smaller than the diameter $d_0$. Therefore, the gap between the hole 17*a* and the associated ball 18*a* is substantially zero and smaller than the gap between the other hole 17*b* and the associated ball 18*b*.

We claim:

1. A variable-capacity swash plate type compressor comprising:

a housing having a crank chamber, a suction chamber, a discharge chamber, and cylinder bores, the cylinder bores being interconnected to the crank chamber, the suction chamber and the discharge chamber;

pistons arranged in the respective cylinder bores;

a drive shaft rotatably arranged in the housing and having an axis, the drive shaft being adapted to rotate in a predetermined direction;

a swash plate arranged in the crank chamber and rotatably and tiltably mounted to the drive shaft, the swash plate having a top dead center position;

means arranged between the swash plate and the pistons for converting the rotational movement of the swash plate into the reciprocal movement of the pistons;

a rotor arranged in the crank chamber and supported by the drive shaft for synchronous rotation therewith;

a hinge mechanism arranged between the rotor and the swash plate for controlling the tilting angle of the swash plate to change a capacity of said compressor;

said hinge mechanism comprising:

a pair of support arms extending from the rotor toward the swash plate on the either side of the top dead center position, each of the support arms having a hole extending parallel to a plane passing through the axis of the drive shaft and the top dead center position and in a direction from an outer position to an inner position relative to the axis of the drive shaft;

a pair of guide pins having respective one ends fixed to the swash plate on either side of the top dead center position and other ends having balls secured thereby, each of the balls being fitted in each of the holes of the support arms; and a gap between one hole and the associated ball, measured at least in the rotational direction of the drive shaft, is substantially zero and smaller than a gap between the other hole and the associated ball, measured in the same direction.

2. A compressor according to claim 1, wherein said holes have different sizes from each other.

3. A compressor according to claim 2, wherein the holes have circular cross-sections with different diameters from each other.

4. A compressor according to claim 3, wherein the balls have identical diameters, one of the circular holes that is located on the rear side from the top dead center position in the rotational direction of the drive shaft has a diameter substantially identical to the diameter of the ball, and the other circular hole that is located on the front side from the top dead center in the rotational direction of the drive shaft has a diameter greater than the diameter of said one circular hole.

5. A compressor according to claim 2, wherein one of the holes has a circular cross-section and the other hole has an oblong cross section having a short width along a short axis extending parallel to the axis of the drive shaft and a long width along a long axis extending in the rotating direction of the drive shaft.

6. A compressor according to claim 5, wherein the balls have identical diameters, the circular hole is located on the rear side from the top dead center position in the rotational direction of the drive shaft and has a diameter substantially identical to the diameter of the ball, and the oblong hole is located on the front side from the top dead center in the rotational direction of the drive shaft, the long width of the oblong hole being greater than the diameter of the ball and the short width thereof substantially identical to the diameter of the ball.

7. A compressor according to claim 5, wherein the balls have identical diameters, the circular hole is located on the front side from the top dead center position in the rotational direction of the drive shaft and has a diameter substantially identical to the diameter of the ball, and the oblong hole is located on the rear side from the top dead center in view of the rotational direction of the drive shaft, the long width of the oblong hole being greater than the diameter of the ball and the short width thereof substantially identical to the diameter of the ball.

8. A compressor according to claim 1, wherein said balls have different sizes from each other.

* * * * *